US008176660B2

(12) United States Patent
Auger et al.

(10) Patent No.: US 8,176,660 B2
(45) Date of Patent: May 15, 2012

(54) CUSTOMIZABLE STUD FOR AN ARTICLE OF FOOTWEAR

(75) Inventors: Perry W. Auger, Tigard, OR (US); Timothy J. Smith, Portland, OR (US); Doug D. Wilken, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 442 days.

(21) Appl. No.: 12/512,678

(22) Filed: Jul. 30, 2009

(65) Prior Publication Data

US 2011/0023329 A1 Feb. 3, 2011

(51) Int. Cl.
*A43B 5/00* (2006.01)

(52) U.S. Cl. ..... 36/134; 36/67 R; 36/67 D

(58) Field of Classification Search ..... 36/67 R, 36/67 D, 134, 132, 114
See application file for complete search history.

(56) References Cited

U.S. PATENT DOCUMENTS

| | | | | |
|---|---|---|---|---|
| 1,942,574 | A | 1/1934 | Shapiro | |
| 2,009,947 | A | 7/1935 | Powning | |
| 2,207,476 | A | 7/1940 | Bernstein | |
| 2,276,887 | A * | 3/1942 | Smith | 36/59 R |
| 2,412,788 | A | 12/1946 | Vietas et al. | |
| 2,491,596 | A * | 12/1949 | Zaleski et al. | 36/59 R |
| 2,911,738 | A * | 11/1959 | Clerke | 36/134 |
| 3,174,235 | A | 3/1965 | Johnston | |
| 3,321,850 | A | 5/1967 | Coker et al. | |
| 4,723,366 | A | 2/1988 | Hagger | |
| 5,361,518 | A * | 11/1994 | Sussmann et al. | 36/134 |
| 5,475,937 | A | 12/1995 | Korsen | |
| 5,617,633 | A | 4/1997 | Lee | |
| 5,617,653 | A * | 4/1997 | Walker et al. | 36/134 |
| 5,638,615 | A | 6/1997 | Korsen | |
| 5,655,317 | A | 8/1997 | Grant | |
| 5,743,029 | A * | 4/1998 | Walker et al. | 36/134 |
| 5,926,980 | A | 7/1999 | Adam | |
| 5,938,384 | A | 8/1999 | Pratt | |
| 5,956,871 | A | 9/1999 | Korsen | |
| 5,957,642 | A | 9/1999 | Pratt | |
| 6,154,984 | A * | 12/2000 | Adam | 36/134 |
| 7,134,226 | B2 | 11/2006 | Robinson, Jr. et al. | |
| 7,165,344 | B2 * | 1/2007 | Blackwell | 36/134 |
| 2006/0277800 | A1 * | 12/2006 | Santos et al. | 36/134 |
| 2008/0271346 | A1 * | 11/2008 | Farmer | 36/134 |
| 2011/0061267 | A1 * | 3/2011 | Dow et al. | 36/134 |

FOREIGN PATENT DOCUMENTS

| | | |
|---|---|---|
| DE | 1695594 | 3/1955 |
| EP | 0163823 | 12/1985 |
| FR | 707836 | 7/1931 |
| GB | 184701 | 8/1922 |
| IT | 1031650 | 2/1975 |

OTHER PUBLICATIONS

International Search Report and Written Opinion, mailed Dec. 20, 2010 in International Application No. PCT/US2010/041914.

* cited by examiner

*Primary Examiner* — Marie Patterson
(74) *Attorney, Agent, or Firm* — Plumsea Law Group, LLC

(57) ABSTRACT

Customizable studs for articles of footwear having variable ground interaction characteristics are disclosed. A customizable stud may generally include a fastening member formed of a fastening member cap and fastening member shaft, a plurality of rings, and a washer. The fastening member cap and the plurality of rings define the ground interaction characteristics of the stud. To vary the ground interaction characteristics, the contour, height, and material makeup of the stud may be altered by varying the shape, number, thickness, length, and material of the rings. The stud components may be sold as a kit with at least one fastening member and a plurality of rings with varying characteristics. The kit may also include at least one washer.

20 Claims, 13 Drawing Sheets

CUSTOMIZABLE STUD FOR AN ARTICLE OF FOOTWEAR

BACKGROUND

The present invention relates generally to studs for articles of footwear, and more specifically to studs having variable ground interaction characteristics.

Athletes playing sports on grass or dirt surfaces often wear articles of footwear with studs attached to the sole. The studs assist the wearer in gripping the playing surface particularly to avoid sliding and allow for sudden turns and stops.

Studs are often designed for a particular playing surface. Studs may differ depending such factors as whether the surface is artificial, natural, soft, firm, wet, indoor, outdoor, or any other type of surface characteristic known in the art. Stud designs may also vary based upon the type of activity, as studs for soccer will differ from those for football. Studs for other particular types of activities may also be provided, such as studs designed for golf, diamond sports, track and field events, or the like.

Various stud configurations have been proposed. For example, U.S. Pat. No. 5,957,642 to Pratt teaches a cleat system for rapid and easy engagement to and disengagement from a shoe. The cleat system includes a nut and shank that may be attached to shoes. Pratt shows a number of different projections and ground engaging portions that may be used with the proposed nut and shank. The projections can be spike-type projections, soft spike projections, baseball-type projections, and soccer-type projections. The different projections illustrate a number of different studs or stud designs that are known in the art.

Stud designs include, among others, European Patent Application Number 0163823A1 to Mione. Mione teaches a screw-on stud for a sports shoe. The stud includes a washer, truncated-cone body, and a screw. The screw fits into a through-hole of a truncated-cone body and the centre hole of the washer. The stud is screwed into a recess of the sports shoe sole. The mating between the washer and truncated-cone body at an annular ridge allows the truncated-cone body to move without deforming the washer. The truncated-cone body may be made of metal such as aluminum or synthetic plastic resin such as nylon.

Another stud design is taught in U.S. Pat. No. 4,723,366 to Hagger, which teaches a cleat with reinforced radial support. The cleat includes a head, threaded stem, collars, flange, and skirt. The skirt is made of polyurethane or other durable and resilient synthetics. The remainder of the cleat is made of metal. The skirt is molded onto the flange during manufacturing so that axial forces applied to the head are evenly transmitted about the flange and the plastic skirt.

The prior art does not disclose a system that allows an athlete to customize a stud in order to vary the ground interaction characteristics of that stud. In particular, the prior art does not disclose the use of a plurality of rings that alter the contour, height, and material makeup of a stud in order to vary the ground interaction characteristics of that stud. Therefore, there is a need in the art for a system that addresses the shortcomings of the prior art discussed above.

SUMMARY

Customizable studs for articles of footwear having variable ground interaction characteristics are disclosed. To vary the ground interaction characteristics, the contour, height, and material makeup of the stud may be altered by varying the shape, number, thickness, length, and material of the rings.

In one aspect, a customizable stud for an article of footwear comprises a fastening member comprising a fastening member cap and a fastening member shaft, a plurality of rings positioned along the fastening member shaft, and wherein altering a position of one of the plurality of rings along the fastening member shaft may alter the ground interaction characteristics of the stud.

In another aspect, a washer disposed along the fastening member shaft may sandwich the plurality of rings between the washer and the fastening member cap.

In another aspect, altering the position of one of the plurality of rings along the fastening member shaft may alter a contour of the stud.

In another aspect, a length of at least one of the plurality of rings may differ from a remainder of the plurality of rings.

In another aspect, a thickness of at least one of the plurality of rings may differ from the remainder of the plurality of rings.

In another aspect, a material of at least one of the plurality of rings may differ from the remainder of the plurality of rings.

In another aspect, the washer comprises a washer first face having a washer recess to receive one of the plurality of rings.

In another aspect, the washer further comprises a washer second face having a friction member configured to grip a sole of an article of footwear when the stud is coupled to the article of footwear.

In another aspect, the fastening member shaft comprises threading.

In another aspect, a stud for an article of footwear, comprises a fastening member comprising a fastening member cap and a fastening member shaft, a plurality of rings placed along the fastening member shaft, and wherein changing a quantity of the plurality of rings along the fastening member shaft alters a height of the stud and alters ground interaction characteristics of the stud.

In another aspect, a washer disposed along the fastening member shaft may sandwich the plurality of rings between the washer and the fastening member cap.

In another aspect, a length of at least one of the plurality of rings may differ from a remainder of the plurality of rings.

In another aspect, a thickness of at least one of the plurality of rings may differ from the remainder of the plurality of rings.

In another aspect, a material of at least one of the plurality of rings differs from the remainder of the plurality of rings.

In another aspect, a kit for customizing a stud for an article of footwear, comprises at least one fastening member comprising a fastening member cap and fastening member shaft, a plurality of rings, wherein at least a portion of the plurality of rings are positioned along the fastening member shaft, and wherein altering a position of one of the at least a portion of the plurality of rings along the fastening member shaft alters a ground interaction characteristic of the stud.

In another aspect the kit comprises at least one washer.

In another aspect, at least one of the plurality of rings may have a ground interaction characteristic different from a remainder of the plurality of rings.

In another aspect, a length of at least one of the plurality of rings may differ from a remainder of the plurality of rings.

In another aspect, a thickness of at least one of the plurality of rings may differ from the remainder of the plurality of rings.

In another aspect, a material of at least one of the plurality of rings may differ from the remainder of the plurality of rings.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Embodiments of the present invention include customizable studs for articles of footwear having variable ground interaction characteristics. A customizable stud may include a plurality of components that may be combined to provide the ground interaction characteristics of the stud. A customizable stud may generally include a fastening member formed of a fastening member cap and fastening member shaft, a plurality of stackable ground engaging elements or rings, and a washer. The fastening member cap and the plurality of rings define the ground interaction characteristics of a stud because these components typically interact with the ground.

To vary the ground interaction characteristics, the contour, height, and material makeup of the stud may be altered, such as by varying the number, thickness, diameter, and material of the rings. Alterations to the configuration of the stud are accomplished by manually removing the stud from an article of footwear, and separating the rings and washer from a fastening member. The rings may be replaced with the same rings in a different configuration or a different set of rings that create a new contour, height, or material makeup for the stud. Before the stud is reattached to the article of footwear, a washer may be added to the assembly. The stud components may be sold as a kit with at least one fastening member and a plurality of rings with varying characteristics. The kit may also include at least one washer. The kit may also include an article of footwear.

Figure 1:
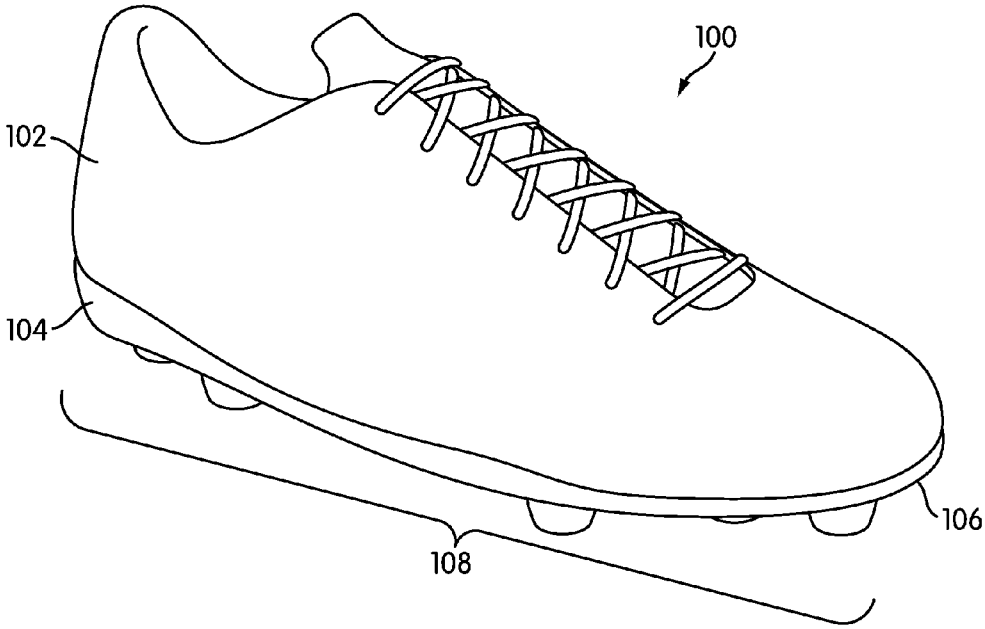
FIG. 1 is a schematic isometric view of an embodiment of an article of footwear with studs.

A customizable stud may be positioned on a sole of an article of footwear. FIG. 1 is a schematic isometric view of an embodiment of an article of footwear 100 with studs 108. Article of footwear 100 may include an upper 102 attached to a sole 104 that includes an outsole 106 and associated group or plurality of studs 108.

Upper 102 may be any type of upper known in the art. Upper 102 is depicted as having a substantially conventional configuration. In some embodiments, upper 102 may be fabricated of using one or more of a plurality of material elements. For example, textiles, foam, leather, and synthetic leather, and leather composite and recycled or recovered materials may be used. In some cases, the leather composite may include a mixture of plastic and shredded leather. In some cases, the shredded leather or plastic can be a regrind. In some cases, the leather or plastic regrind can come from recovered scrap shoes or articles, or from other recycled material. If more than one material is used to construct the upper, those materials may be stitched or adhesively bonded together to form an interior void for securely and comfortably receiving a foot.

Sole 104 may be any type of sole known in the art. Sole 104 is depicted as having a substantially conventional configuration that may incorporate a plurality of material elements (e.g., textiles, foam, leather, and synthetic leather) that are stitched or adhesively bonded together to provide support for the foot.

Given that various aspects of the present application primarily relate to group of studs 108, upper 102 and sole 104 may exhibit the general configuration discussed above or the general configuration of practically any other conventional or non-conventional upper and sole. Accordingly, the structure of upper 102 and sole 104 utilized with group of studs 108 or variants thereof may vary significantly.

Figure 2:
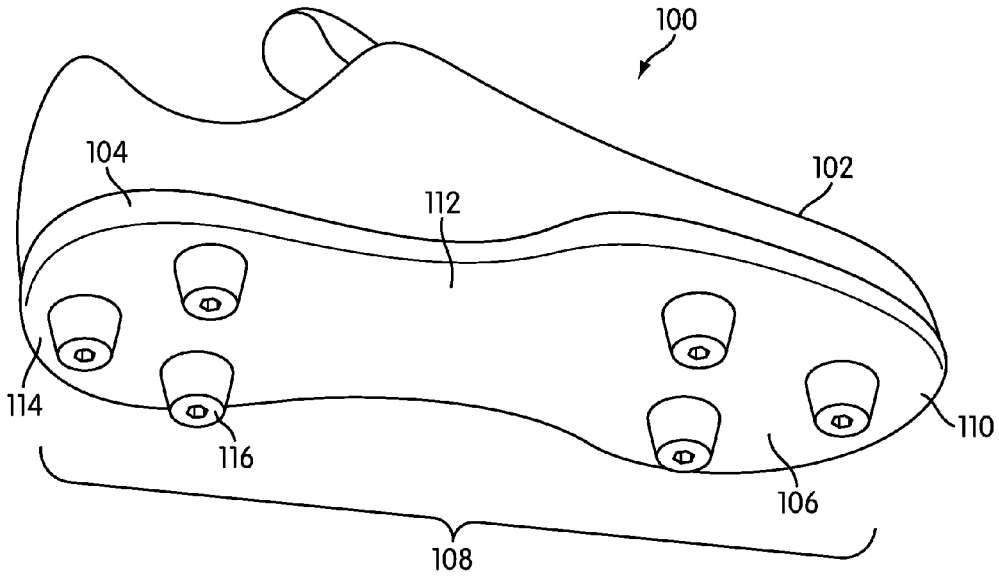
FIG. 2 is a schematic bottom isometric view of an embodiment of an article of footwear with studs.

FIG. 2 is a schematic isometric view of an embodiment of article of footwear 100 showing a bottom surface of article 100. Sole 104 may include a forefoot region 110, mid-foot region 112, and heel region 114. Sole 104 may include a group of studs 108 or a single stud, such as first stud 116, disposed at any location on outsole 106 in any of regions 110, 112, and 114.

In different embodiments, the number, spacing, location, and general shape of studs 108 may vary. The number, spacing, location, and general shape of studs 108 may vary based on the type of sport, terrain, or user preferences. In the exemplary embodiment, shown in FIG. 2, six studs 108 are provided, with three substantially equally spaced studs 108 positioned in forefoot region 110 and three substantially equally spaced studs 108 positioned in heel region 114. However, in other embodiments, there may be fewer or more studs 108, spaced closer together or further apart, and disposed at different locations along sole 104.

Additionally, in the exemplary embodiment shown in FIG. 2, each stud 108 may be generally circular in shape. However, in other embodiments, the general shape of any or all of studs 108 may differ. For example, any of studs 108 may have a bladed configuration or any other type of stud configuration known in the art.

Figure 3:
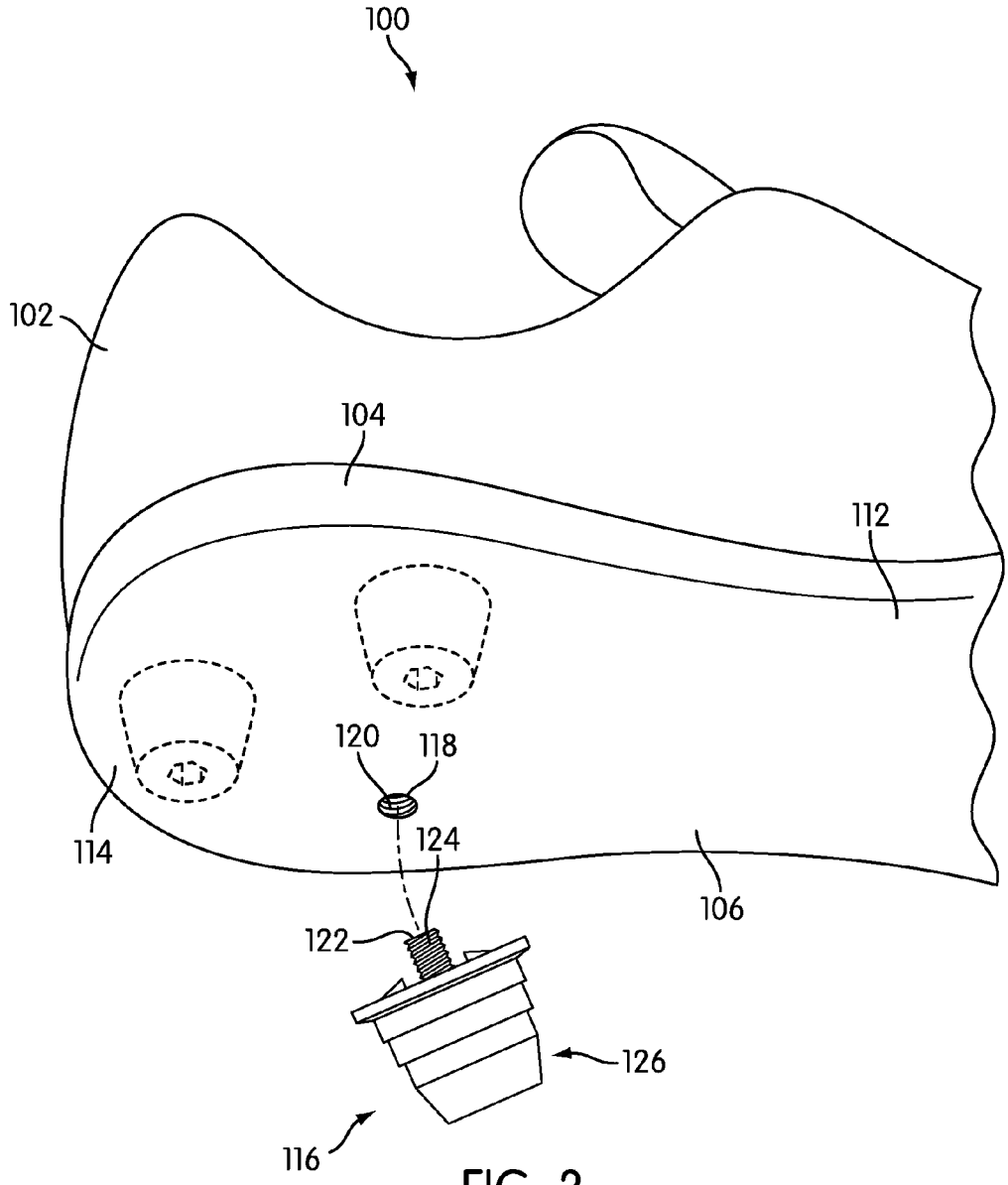
FIG. 3 is a schematic isometric view of an embodiment of a heel region of an article of footwear with studs.

At least some of studs 108 associated with article of footwear 100 may be detachable from article of footwear 100. FIG. 3 is a schematic isometric view of an embodiment of a heel region of an article of footwear with studs. Referring to FIG. 3, first stud 116 may be releasably connected to sole 104 by a first stud fastening member 126. Sole 104 may include a sole hole 118, and first stud fastening member 126 may include a first stud fastening member shaft 122. First stud fastening member shaft 122 may be received in sole hole 118 for connectivity purposes.

In different embodiments, the manner in which first stud 116 may be connected to sole 104 may vary. The connection may be any connection feature known in the art, including press-fit or snap-fit configurations. In an exemplary embodiment shown in the FIG. 3, stud 116 may be screwed into stud hole 118 using stud hole threading 120 located on the interior of stud hole 118 and shaft threading 124 located on the exterior of first stud fastening member shaft 122. In other words, first stud fastening member 126 may be a type of screw. However, in other embodiments, other connection features may be used.

Figure 4:
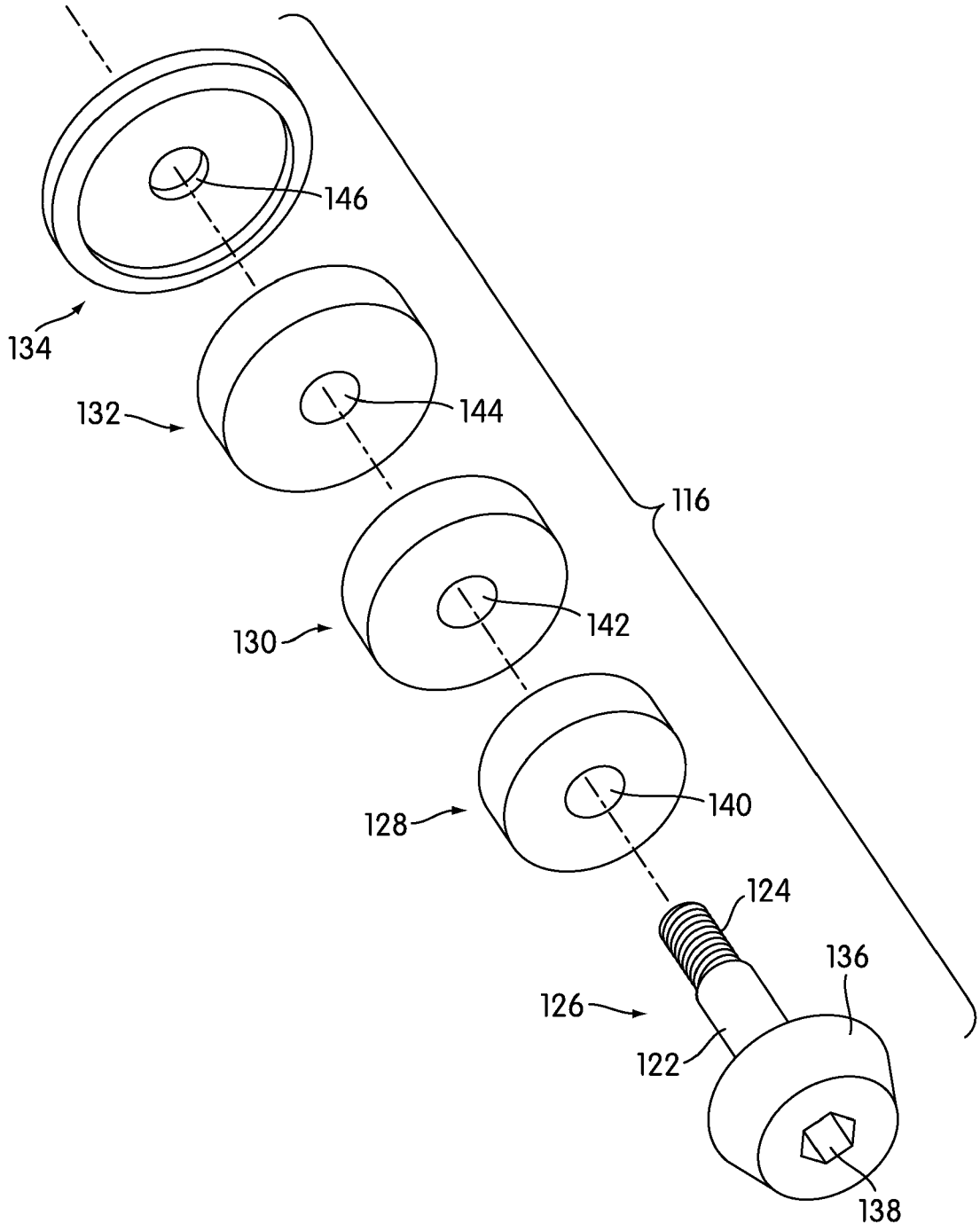
FIG. 4 is a schematic exploded view of a first embodiment of a stud.

A customizable stud may include a plurality of components that combine to create desired connectivity features and ground interaction characteristics of the stud. FIG. 4 is a schematic exploded view of a first embodiment of a stud. Referring to FIG. 4, first stud 116 may include first stud fastening member 126, first stud first ring 128, first stud second ring 130, first stud third ring 132, and first stud washer 134. First stud first ring, second ring, third ring, and washer 128, 130, 132, 134 include first ring, second ring, third ring, and washer apertures 140, 142, 144, 146, respectively. Fastening member shaft 122 may be inserted through first ring, second ring, third ring, and washer apertures 140, 142, 144, 146 for assembly purposes.

In addition to releasably connecting first stud 116 to an article of footwear, first stud fastening member 126 aligns and supports the other stud components when assembled. First stud washer 134 may be utilized to distribute loads applied to first stud 116 and assist in retaining first stud 116 to an article of footwear.

Figure 5:
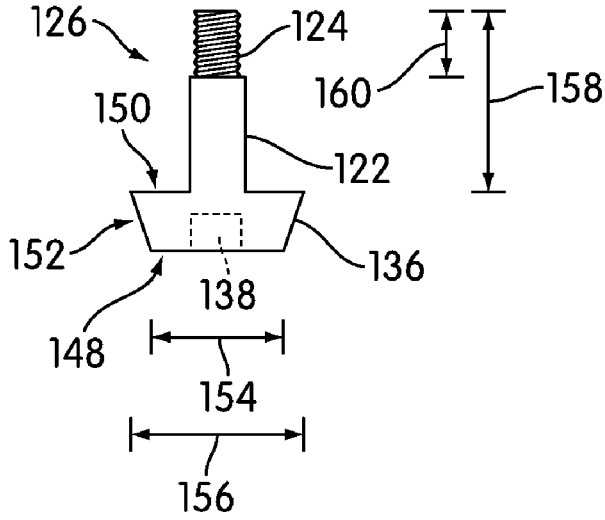
FIG. 5 is a schematic side view of an embodiment of a fastening member.

FIG. 5 is a schematic side view of an embodiment of a fastening member. First stud fastening member 126 may include fastening member shaft 122 and fastening member cap 136. Fastening member shaft 122 may include shaft threading 124. Fastening member shaft 122 may have a shaft length 158 and shaft threading 124 may have a shaft threading length 160.

In different embodiments, shaft length 158 may vary to alter the ground interaction characteristics of first stud 116. When assembled to an article of footwear, shaft length 158 typically contributes to the height of a stud. Shaft length 158 may be any length typical for the sport, appropriate for the playing surface, and preferred by the wearer.

In different embodiments, shaft threading length 160 may vary. Shaft threading length 160 may be any length, such as a length that is comfortable for the wearer or a length that does not extend past sole 104 of article of footwear 100 when first stud 116 is connected to article of footwear 100, as is shown in FIGS. 1-3. Depending on how far fastening member shaft 122 may be screwed into a sole, shaft threading length 160 typically contributes to the height of a stud. In some embodiments, shaft threading length 160 may equal the thickness of sole 104. However, in other embodiments, shaft threading length 160 may be smaller or larger than the thickness of sole 104.

Fastening member cap 136 may include a cap first side 148, a cap second side 150, and a cap perimeter surface 152 connecting cap first side 148 and cap second side 150. When assembled to create first stud 116, cap second side 150 may contact first stud first ring 128, and cap first side 148 and cap perimeter surface 152 may form part of a ground interaction surface of first stud 116.

Cap first side 148 may include a cap recess 138. Cap recess 138 may be utilized to assist in connecting and removing first stud fastening member 126 to and from an article of footwear. In one embodiment, cap recess 138 may be sized to fit a wrench. However, in other embodiments, cap recess 138 may be sized to fit other instruments or fingers. In some embodiments, cap recess 138 may be eliminated entirely.

Cap first side 148 has a cap first side length 154, and cap second side 150 has a cap second side length 156. In different embodiments, cap first side length 154 may vary. Cap first side length 154 may be any length typical for the sport, appropriate for the playing surface, and preferred by the wearer. In different embodiments, cap second side length 156 may vary. In an exemplary embodiment shown in FIG. 5, cap second side length 156 may be larger than cap first side length 154. However, in other embodiments, cap second side length 156 may be equal to or smaller than cap first side length 154.

Figure 6:
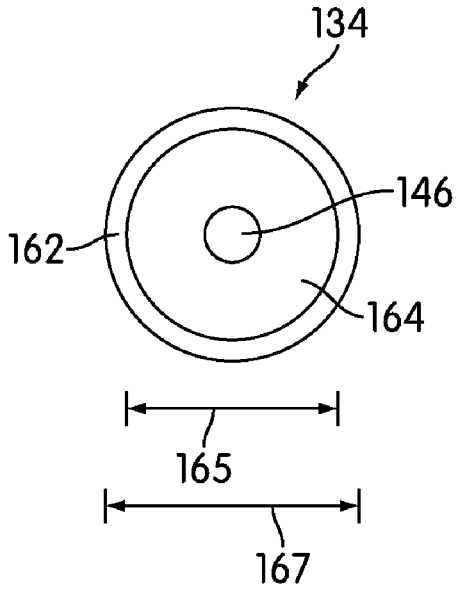
FIG. 6 is a schematic plan view of an embodiment of a first face of a washer.

FIG. 6 is a schematic plan view of an embodiment of a first face of a washer. First stud washer 134 may include a washer first face 162 with a washer recess 164. Washer recess 164 may assist in positioning or aligning at least one ring associated with first stud 116. Washer aperture 146 may be positioned on washer recess 164. Washer recess 164 has a washer recess length 165, and washer first face 162 has a washer first face length 167.

In different embodiments, washer first face length 167 may vary. In some embodiments, washer first face length 167 may be any length larger than the other first stud 116 components. However, in other embodiments, washer first face length 167 may be smaller than other first stud 116 components.

In different embodiments, washer recess length 165 may vary. Washer recess length 165 may generally be smaller than washer first face length 167. In some embodiments, washer recess length 165 may be at least as large as first stud third ring 132 that may be positioned inside washer recess 164. However, in other embodiments, washer recess length 165 may be larger or smaller than first stud third ring 132.

Figure 7:
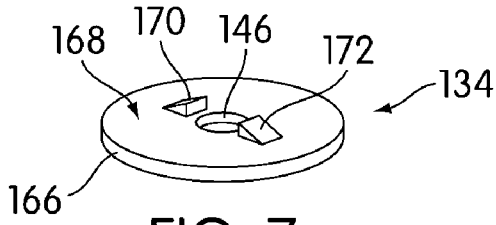
FIG. 7 is a schematic isometric view of an embodiment of a washer.

FIG. 7 is a schematic isometric view of an embodiment of a washer. Referring to FIG. 7, in addition to washer first face 162, first stud washer 134 may include washer perimeter surface 166 and washer second face 168. Washer throughhole 146 may extend from washer first face 162 to washer second face 168. When first stud 116 is assembled, washer second face 168 may be oriented toward or contact a sole of an article of footwear.

First stud washer 134 may include features to help first stud 116 remain connected or fixed to an article of footwear. Friction members 170, 172 may be positioned on washer second face 168 and provide friction between first stud 116 and article of footwear 100. Friction members 170 and 172 may be utilized to help maintain the relative positions of first stud 116 and article of footwear 100, for example, so that first stud 116 resists bending during a hard cut.

In different embodiments, the shape, number, and location of friction members 170, 172 may vary. In an exemplary embodiment shown in the figures, friction members 170, 172 may be two peak-shaped protrusions located approximately 180 degrees apart on washer second face 168. However, in other embodiments, the shape, number, and location of friction members 170, 172 may vary. For example, in other embodiments, a gritty material may cover all or part of washer second face 168, more or less than two friction members may be utilized, and friction members 170, 172 may be dome shaped or concave.

Figure 8:
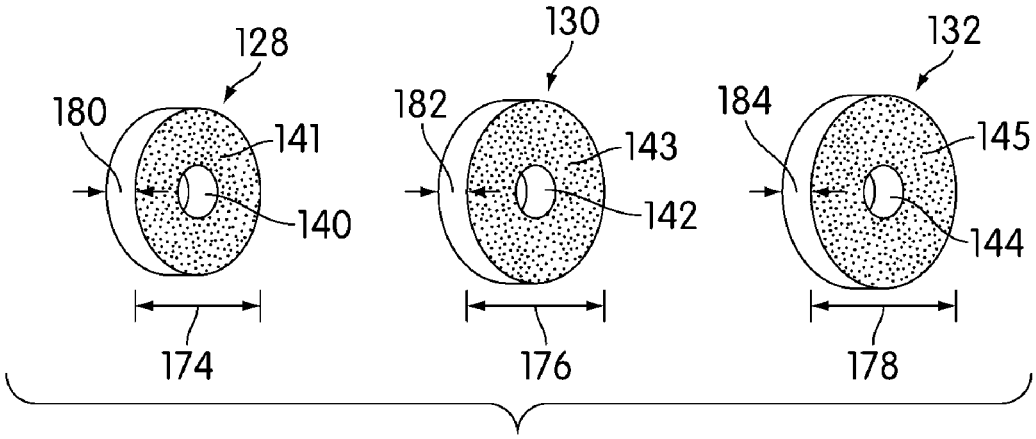
FIG. 8 is a schematic isometric view of embodiments of three rings.

FIG. 8 is a schematic isometric view of embodiments of three rings. Referring to FIG. 8, first stud 116 may include first stud first ring 128, first stud second ring 130, and first stud third ring 132. First stud first ring 128 may include a first ring through-hole 140, a first ring material 141, a first ring length 174, and a first ring thickness 180. First stud second ring 130 may include a second ring through-hole 142, a second ring material 143, a second ring length 176, and a second ring thickness 182. First stud third ring 132 may include a third ring through-hole 144, a third ring material 145, a third ring length 178, and a third ring thickness 184.

In different embodiments, the shape, material, length, and thickness of each first stud ring 128, 130, 132 may vary. In the exemplary embodiment shown in FIGS. 3-4 and 8, each first stud ring 128, 130, 132 may be generally circular in shape. However, in other embodiments, first stud rings 128, 130, 132 may be a different shape. For example, in other embodiments, first stud ring 128, 130, 132 may be oblong or blade-like in shape or have any geometric shape known in the art.

In the exemplary embodiment shown in FIGS. 3-4 and 8, first ring material 141, second ring material 143, and third ring material 145 may be the same material. However, in other embodiments, a different material may be used to construct any of the three rings or each ring may be constructed of different materials. The ring material may be any natural or synthetic material, including leather, plastic, and rubber. One or more of the rings, the stud fastening member, the stud washer, or the entire stud assembly may be made of any of the materials described above in connection with the upper. For example, textiles, foam, leather, and synthetic leather, and leather composite and recycled or recovered materials may be used. In some cases, the leather composite may include a mixture of plastic and shredded leather. In some cases, the shredded leather or plastic can be a regrind. In some cases, the leather or plastic regrind can come from recovered scrap shoes or articles, or from other recycled material. The material may vary in stiffness, texture, water permeability, etc. The characteristics of the material directly affect the ground interaction characteristics of the ring, so different materials may be selected based upon the anticipated use of the article of footwear. For example, a ring having a first material could be selected for playing on a natural outdoor surface in good weather, while a ring made from a second, different material could be selected for playing on the same surface in wet weather. Similarly, a ring made from a third material, different from either of the first two materials, may be selected for playing on an outdoor synthetic playing surface, and a ring made from a fourth material, different from any of the first three materials may, may be selected for playing on an indoor synthetic playing surface.

In the exemplary embodiment shown in FIGS. 3-4 and 8, first ring length 174 may be smaller than second ring length 176, and second ring length 176 may be smaller than third ring length 178. In other words, the ring lengths progressively increase in size from fastening member cap 136 (shown in FIGS. 4 and 5) to first stud washer 134 (shown in FIGS. 4, 6, and 7). However, in other embodiments, the ring lengths may progressively decrease in size, remain approximately equal, or vary in a different manner.

In the exemplary embodiment shown in FIGS. 3-4 and 8, first ring thickness 180, second ring thickness 182, and third ring thickness 184 may be approximately equal. However, in other embodiments, the thickness of each first stud ring 128, 130, 132 may be thicker, thinner, or approximately equal to the current thickness of the first stud rings 128, 130, 132.

Figure 9:
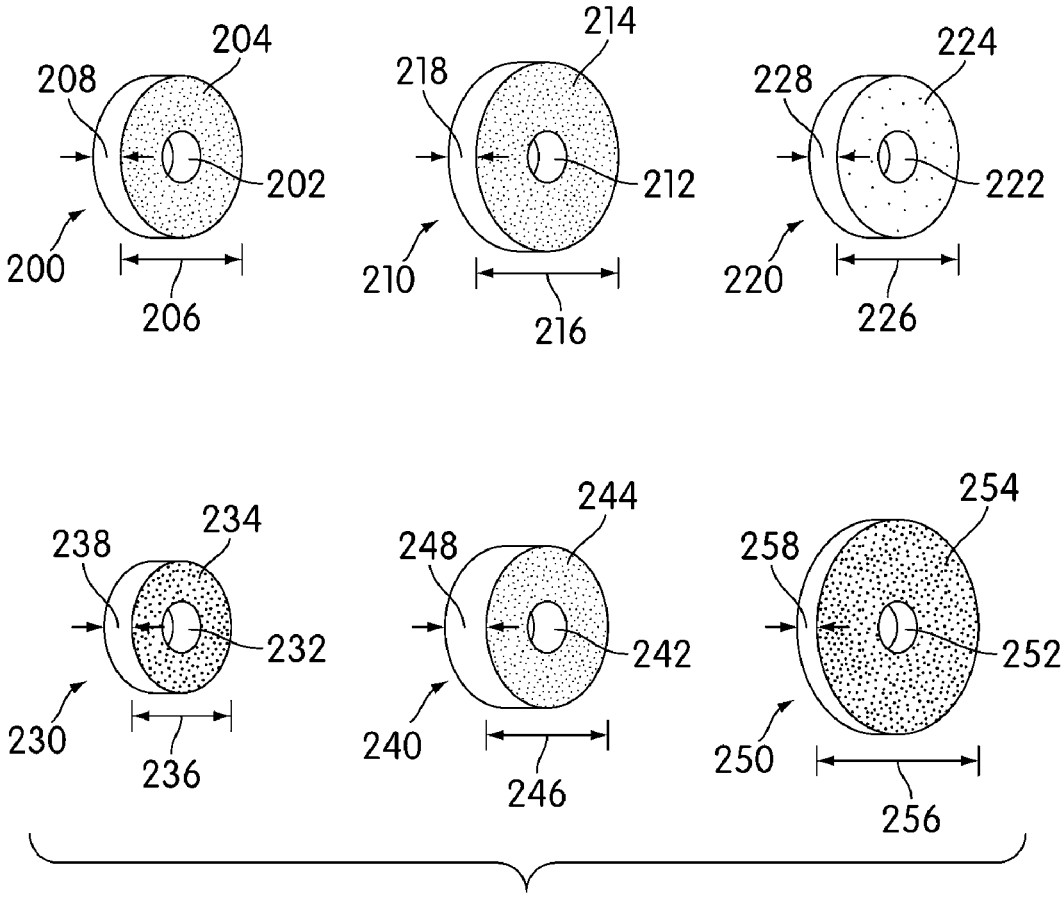
FIG. 9 is a schematic isometric view of embodiments of six rings.

Varying rings made of varying materials, having different lengths and thicknesses may be utilized to create a stud. First stud first ring 128, first stud second ring 130, and first stud third ring 132 may be substituted with other rings having different characteristics. FIG. 9 is a schematic isometric view of embodiments of six rings. Referring to FIG. 9, fourth ring 200, fifth ring 210, sixth ring 220, seventh ring 230, eighth ring 240, and ninth ring 250 each have different characteristics. Fourth ring 200 may include a fourth ring through-hole 202, a fourth ring material 204, a fourth ring length 206, and a fourth ring thickness 208. Fifth ring 210 may include a fifth ring through-hole 212, a fifth ring material 214, a fifth ring length 216, and a fifth ring thickness 218. Sixth ring 220 may include a sixth ring through-hole 222, a sixth ring material 224, a sixth ring length 226, and a sixth ring thickness 228. Seventh ring 230 may include a seventh ring through-hole 232, a seventh ring material 234, a seventh ring length 236, and a seventh ring thickness 238. Eighth ring 240 may include an eighth ring through-hole 242, an eighth ring material 244, an eighth ring length 246, and an eighth ring thickness 248. Finally, ninth ring 250 may include a ninth ring through-hole 252, a ninth ring material 254, a ninth ring length 256, and a ninth ring thickness 258. To vary the characteristics of the studs, any of the characteristics of any of the rings may also be varied, such as material, length, position of the through-hole, and/or the thickness.

Fifth ring 210, sixth ring 220, seventh ring 230, eighth ring 240, and ninth ring 250 may be described by comparing them to the characteristics of fourth ring 210. Fourth ring 210 may be constructed of fourth ring material 204 that, in some embodiments, may be similar to fifth ring material 214 and eighth ring material 244, but different from sixth ring material 224, seventh ring material 234, and ninth ring material 254. Additionally, sixth ring material 224 may be different from seventh ring material 234 and ninth ring material 254. In other embodiments, all of the rings may be made from different materials, or various combinations of rings may be made from the same or similar materials.

Fourth ring 200 may be a fourth ring length 206 that, in some embodiments, may be approximately equal to sixth ring length 226 and eighth ring length 246. In some embodiments, fourth ring length 206 may be smaller than fifth ring length 214 and ninth ring length 254. In some embodiments, fifth ring length 214 may also be smaller than ninth ring length 254. Additionally, in some embodiments, fourth ring length 206 may be larger than seventh ring length 234.

Fourth ring 210 may be a fourth ring thickness 208 that may, in some embodiments, be approximately equal to fifth ring thickness 218, sixth ring thickness 228, and seventh ring thickness 238. In these and other embodiments, fourth ring thickness 208 may be thinner than eighth ring thickness 248 and thicker than ninth ring thickness 258.

Rings of varying materials, lengths, and thicknesses may be utilized to create studs of varying stud bodies. The varying stud body configurations and contours create different ground interaction characteristics from one stud to the next. For example, if a first stud has a first set of rings positioned on the stud shaft in a first order and a second stud has a second set of identical rings positioned on the stud shaft in a second order, the contours of the two studs are different. The different contours yield different ground interaction characteristics. Similarly, if a first stud has a first set of rings positioned on the stud shaft and a second stud has a second set of rings having made from a different material than the first set of rings, the ground interaction characteristics of the two studs will differ.

Figure 10:
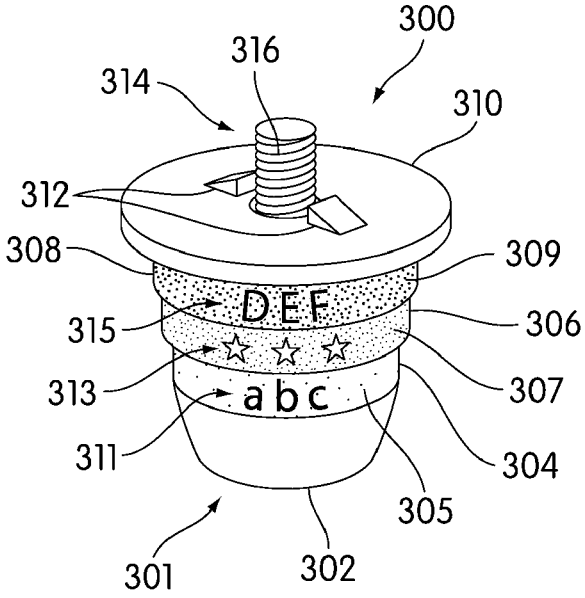
FIG. 10 is a schematic isometric view of a second embodiment of a stud.

FIGS. 10-13 illustrate four embodiments of studs with varying and variable ground characteristics. FIG. 10 is a schematic isometric view of a second embodiment of a stud. Referring to FIG. 10, a second stud 300 may include a second stud fastening member 301, a second stud first ring 304, a second stud second ring 306, a second stud third ring 308, and a second stud washer 310. Second stud fastening member 301 may include a fastening member cap 302 and a fastening member shaft 314 having a fastening member shaft threading 316. Second stud washer 310 may include friction members 312.

In the second embodiment shown in FIG. 10, second stud 300 may include second stud rings 304, 306, 308. Second stud rings 304, 306, and 108 may vary in length from fastening member cap 302 to second stud washer 310. In the embodiment shown in FIG. 10, the length of each individual ring increases. In other embodiments, the lengths of the rings may vary in other ways. Second stud rings 304, 306, 308 may be made of the same, similar, or different materials.

Second stud rings 304, 306, 308 may also include first ring image 311, second ring image 313, and third ring image 315 disposed on first ring perimeter surface 305, second ring perimeter surface 307, and third ring perimeter surface 309 respectively. An image may be any graphic or text able to be disposed on a stud ring. These images may be used to further customize the aesthetic look of a stud, such as with a wearer's team number, team logo, name, sponsor image.

In different embodiments, the depicted image of first ring image 311, second ring image 313, and third ring image 315 may vary. In the exemplary embodiment shown in FIG. 10, second stud first ring 304 may include first ring image 311 that includes text "abc." Second stud second ring 306 may include second ring image 313 that includes three stars. Second stud third ring 308 may include third ring image 315 that includes text "DEF." However, in other embodiments, other images may be utilized, including logos.

Further, the rings may all be the same color or they may be different colors. Each size ring may be a different color, or each size ring may be available in an assortment of colors. This allows for the rings to be stacked to create patterns of colors.

Figure 11:
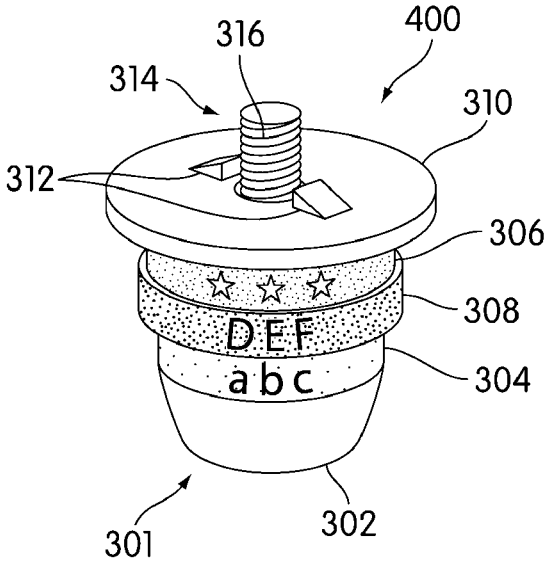
FIG. 11 is a schematic isometric view of a third embodiment of a stud.

FIG. 11 is a schematic isometric view of a third embodiment of a stud. Referring to FIG. 11, third stud 400 may include the same components included in second stud 300. However, the positions of second ring 306 and third ring 308 may be interchanged. Second ring 306 may be positioned between washer 310 and third ring 308, and third ring 308 may be positioned between first ring 304 and second ring 306. In this manner, the ground interaction characteristics of third stud 400 may be altered from the ground interaction characteristics of second stud 300.

Figure 12:
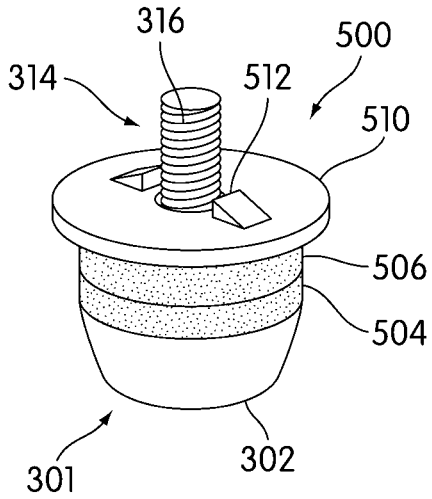
FIG. 12 is a schematic isometric view of a fourth embodiment of stud.

FIG. 12 is a schematic isometric view of a fourth embodiment of stud. Referring to FIG. 12, fourth stud 500 may include fastening member 301 used in the second and third embodiments, fourth stud first ring 504, fourth stud second ring 506, and fourth stud washer 510. Fastening member 301 may include fastening member cap 302 and fastening member shaft 314 having fastening member shaft threading 316. Fourth stud washer 510 may include friction members 512.

In the fourth embodiment shown in FIG. 12, fourth stud 500 may include two stud rings 504, 506 constructed of similar materials. In the present case, the combined height of stud rings 504, 506 may be shorter than combined height of the stud rings 128, 130, 132 of first stud 116 (see FIG. 4) or the stud rings 304, 306, 308 of second and third studs 300, 400. Due to the shorter height of stud rings 504, 506 of fourth stud 500, additional shaft threading 316 may be visible. As a result, when fourth stud 500 is connected to an article of footwear, fourth stud 500 may lower the height of the shoe.

Figure 13:
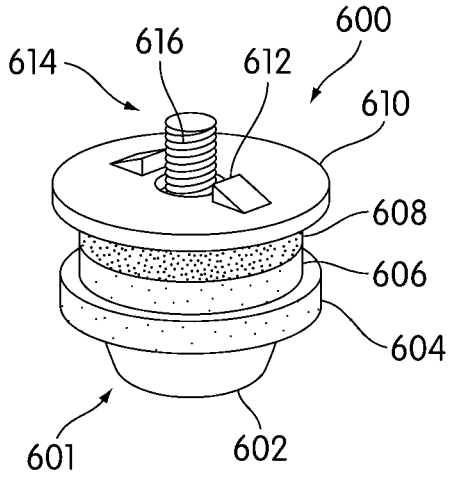
FIG. 13 is a schematic isometric view of a fifth embodiment of a stud.

FIG. 13 is a schematic isometric view of a fifth embodiment of a stud. Referring to FIG. 13, fifth stud 600 may include fifth stud fastening member 601, fifth stud first ring 604, fifth stud second ring 606, fifth stud third ring 608, and fifth stud washer 610. Fifth stud fastening member 601 may include fastening member cap 602 and fastening member shaft 614 having fastening member shaft threading 616. Fifth stud washer 610 may include friction members 612.

In the fifth embodiment, fifth stud 600 may include fifth stud rings 604, 606, 608 where first ring 604 may be larger than second ring 606 and third ring 608. Second ring 606 and third ring 608 may be approximately the same size. Fifth stud 600 may include fifth stud rings 604, 606, 608 where first ring 604 and second ring 606 may be constructed of the same material, and third ring 608 may be constructed of a different material. As shown in FIGS. 10-12, fifth stud 600 may also include fastening member 601 having fastening member cap 602 that is smaller than fastening member cap 302.

Alterations to the configuration of the stud are accomplished by manually removing the stud from an article of footwear, and separating the rings and washer from the fastening member. The rings may be replaced with the same rings in a different configuration or a different set of rings that create a new contour, height, or material makeup for the stud.

Figure 14:
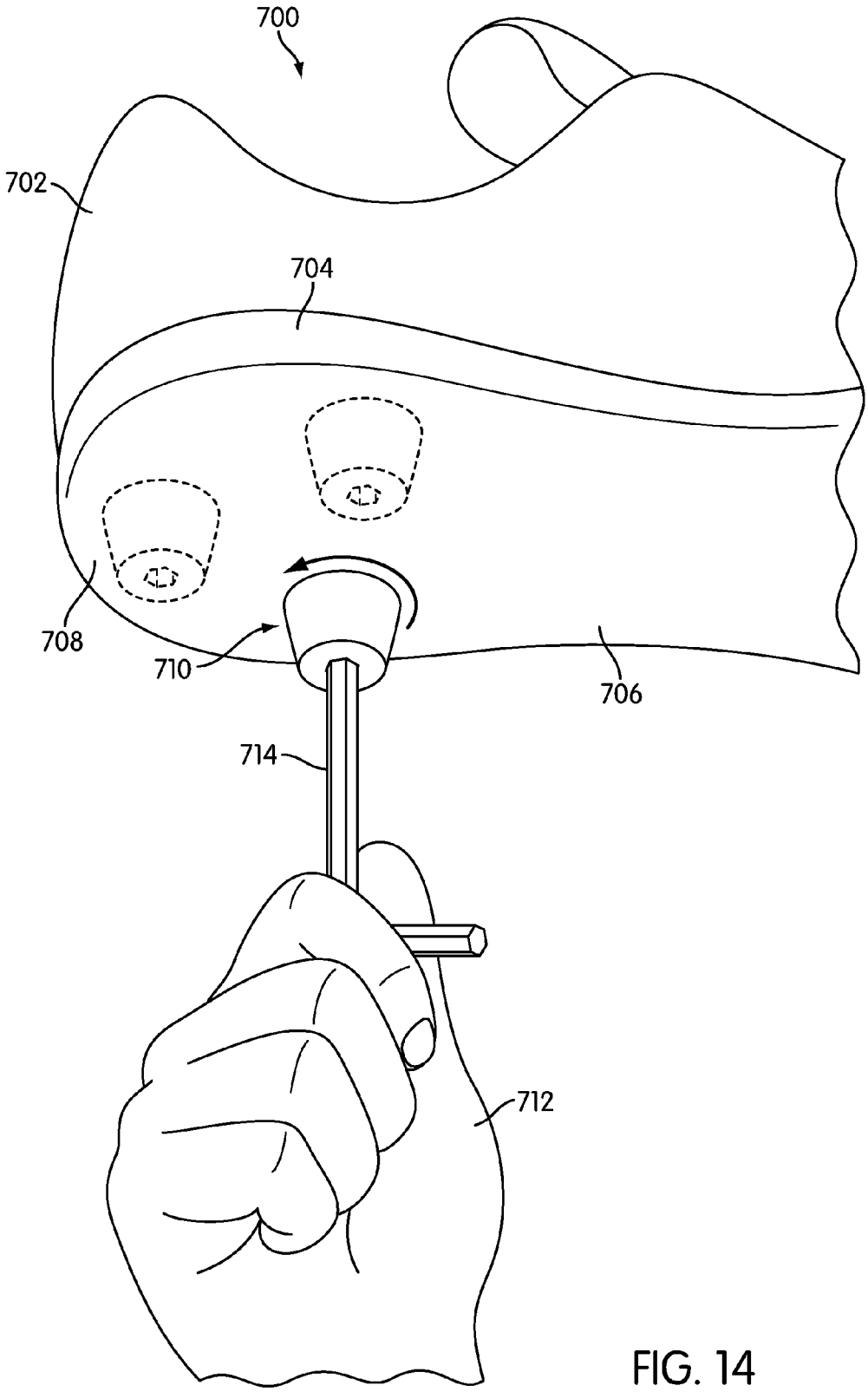
FIG. 14 is a schematic isometric view of an embodiment of an article of footwear with studs where one stud is being removed from the article of footwear.
Figure 15:
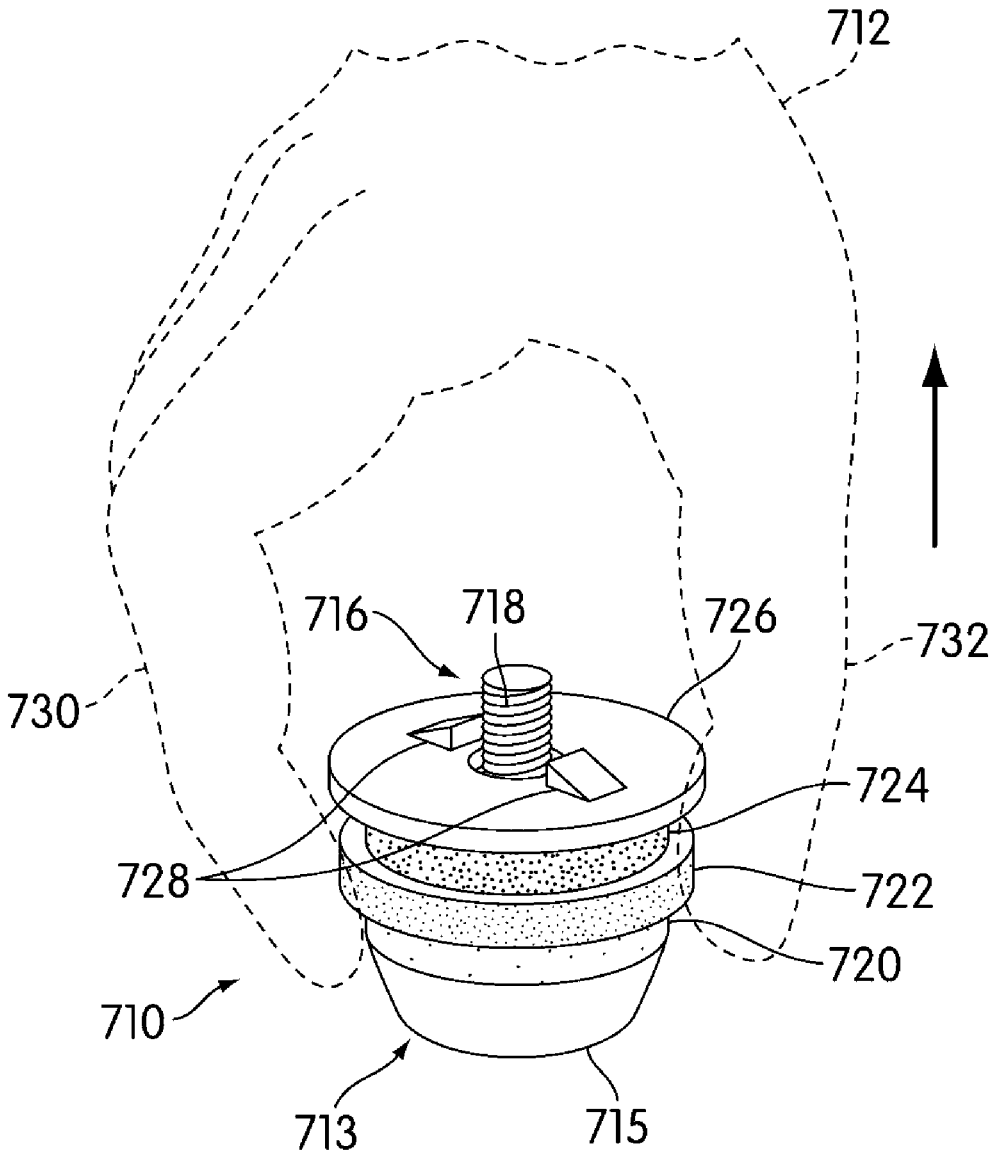
FIG. 15 is a schematic isometric view of a hand removing three rings and a washer from a sixth embodiment of a stud.
Figure 16:
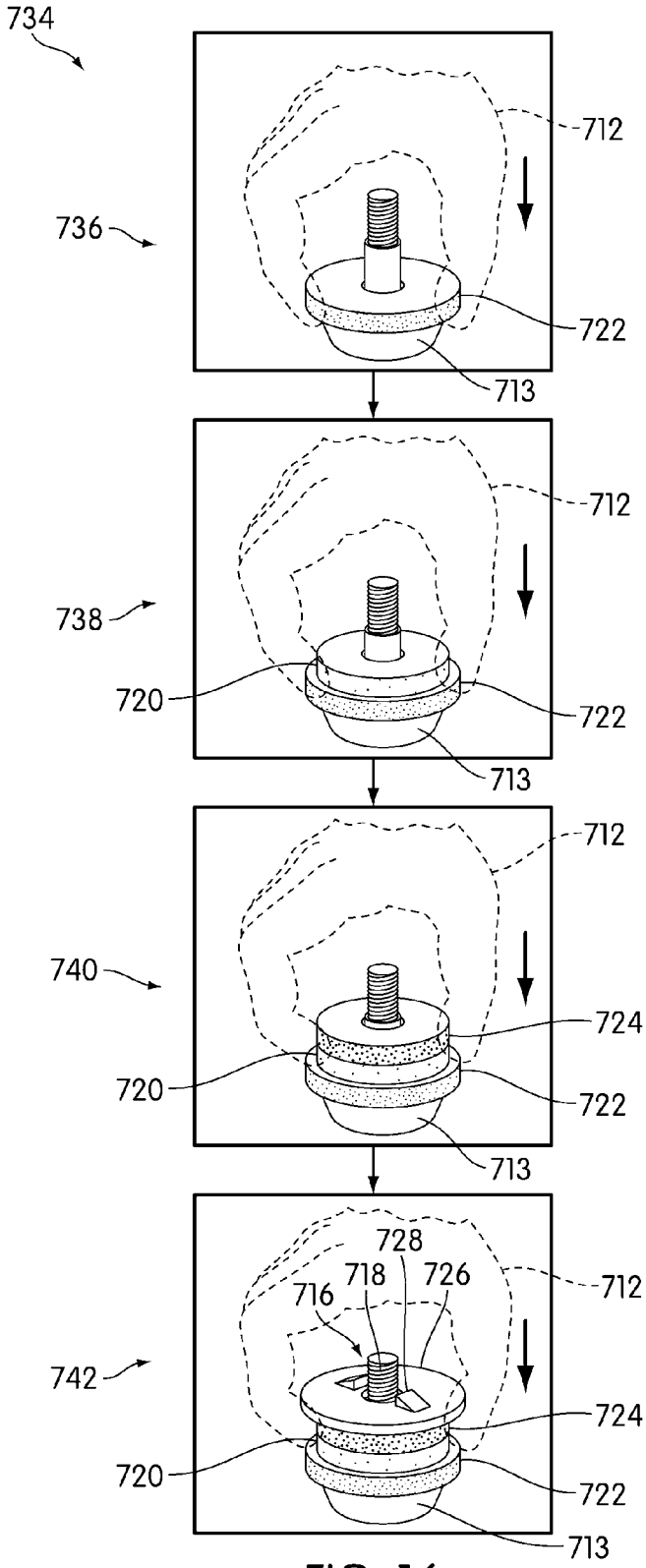
FIG. 16 is a series of schematic isometric views of a hand adding three rings and a washer to reassemble a stud.

A stud may be removed from an article of footwear for a variety of reasons, including cleaning and reconfiguration. FIGS. 14-16 illustrate how a stud may be removed from an article of footwear, altered to a different configuration, and the differently configured stud attached to the article of footwear. FIG. 14 is a schematic isometric view of an embodiment of an article of footwear with studs where one stud is being removed from the article of footwear. Referring to FIG. 14, article of footwear 700 may include an upper 702 attached to a sole 704 that includes an outsole 706 and a group of studs disposed on heel region 708.

In some embodiments, each stud may be removed using a tool. However, in other embodiments, each stud may be removed without the use of a tool, such as with the fingers. In the exemplary embodiment shown in FIG. 14, a sixth embodiment of a stud or sixth stud 710 may be manually removed from article of footwear 700 by hand 712 and wrench 714.

FIG. 15 is a schematic isometric view of a hand removing three rings and a washer from a sixth embodiment of a stud. Referring to FIG. 15, sixth stud 710 may include sixth stud fastening member 713, sixth stud first ring 720, sixth stud second ring 722, sixth stud third ring 724, and sixth stud washer 726. Sixth stud fastening member 713 may include fastening member cap 715 and fastening member shaft 716 having fastening member shaft threading 718. Sixth stud washer 726 may include friction members 728.

In the sixth embodiment shown in FIG. 15, sixth stud 710 may include sixth stud rings 720, 722, 724 that increase and then decrease in length from fastening member cap 715 to sixth stud washer 726. Sixth stud 710 may also include sixth stud rings 720, 722, 724 of varying materials.

Sixth stud 710 may be disassembled manually. For example, as shown in FIG. 15, first finger 730 and second finger 732 of hand 712 may be used to remove first ring 720, second ring 722, third ring 724, and washer 726 from fastening member 713.

Sixth stud 710 may then be reassembled using the same components that were removed or other components having similar or different characteristics. FIG. 16 is a schematic isometric view of a hand adding three rings and a washer to reassemble a stud. Stud reassembly process 734 may include a first step 736, second step 738, third step 740, and fourth step 742. Stud reassembly process 734 reassembles sixth stud 710 using the original components.

First step 736 includes using hand 712 to dispose second ring 722 on fastening member 713. Second step 738 includes using hand 712 to dispose first ring 720 on fastening member 713 and second ring 722. Third step 740 includes using hand 712 to dispose third ring 724 on fastening member 713 and first ring 720. Fourth step 742 includes using hand 712 to dispose washer 726 on fastening member 713 and third ring 724. The assembled stud may be reattached to article of footwear 700 (see FIG. 14) using hand 712 and wrench 714.

Figure 17:
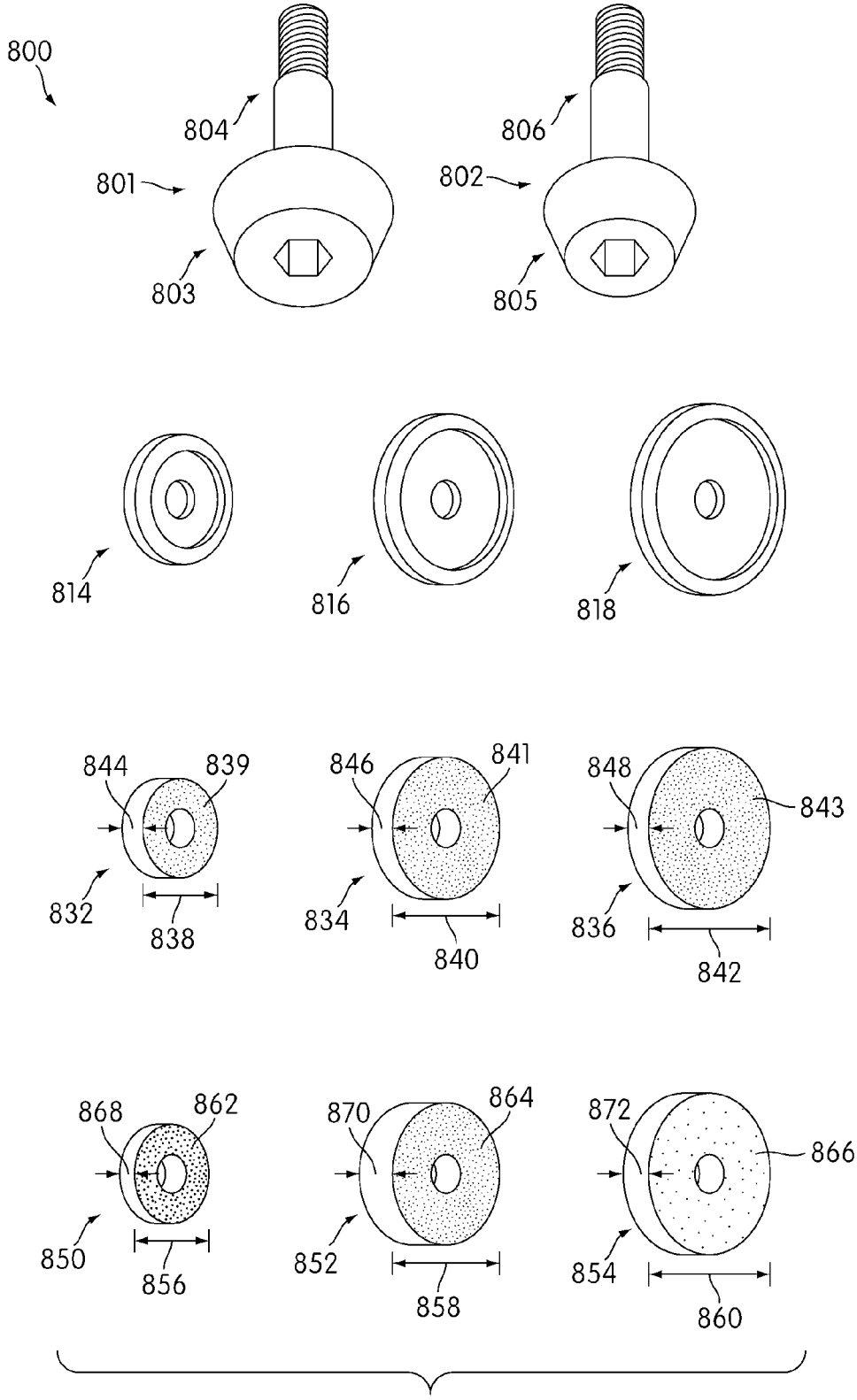
FIG. 17 is a schematic isometric view of an embodiment of a kit for creating varying configurations of studs.

The stud components may be sold as a kit with at least one fastening member and a plurality of rings with varying characteristics as the components that can be used to form one or more complete studs. The kit may also include at least one washer. FIG. 17 is a schematic isometric view of an embodiment of a kit for creating varying configurations of studs. A kit 800 may be assembled so that the wearer of an article of footwear may customize one or more studs using the components provided in kit 800. Kit 800 may include kit first fastening member 801, kit second fastening member 802, kit first washer 814, kit second washer 816, kit third washer 818, kit first ring 832, kit second ring 834, kit third ring 836, kit fourth ring 850, kit fifth ring 852, and kit sixth ring 854.

First and second fastening members 801, 802 may be included in kit 800. First fastening member 801 may include first fastening member cap 803 and first fastening member shaft 804. Second fastening member 802 may include second fastening member cap 805 and second fastening member shaft 806.

In different embodiments, the number and size of the fastening members may vary. In the exemplary embodiment shown in FIG. 17, kit 800 includes two fastening members 801, 802. However, in other embodiments, more or less than two fastening members may be included in kit 800. In the exemplary embodiment shown in FIG. 17, first fastening member 801 may be larger than second fastening member 802. Specifically, first fastening member cap 803 may be larger than second fastening member cap 805. However, in other embodiments, the size of first and second fastening members 801, 802 may be approximately equal or fastening member shafts 804, 806 may vary in size.

First, second, and third washers 814, 816, 818 may be included in kit 800. In different embodiments, the number and size of the washers may vary. In the exemplary embodiment shown in FIG. 17, kit 800 includes three washers 814, 816, 818. However, in other embodiments, more or less than three washers may be included in kit 800. In the exemplary embodiment shown in FIG. 17, first washer 814 may be smaller than second washer 816, and second washer 816 may be smaller than third washer 818. However, in other embodiments, the size of first, second, and third washers 814, 816, 818 may be approximately equal or vary in size in a different manner.

First, second, third, fourth, fifth, and sixth rings 832, 834, 836, 850, 852, 854 may be included in kit 800. First ring 832 may be constructed of a first ring material 839 and include a first ring length 838 and first ring thickness 844. Second ring 834 may be constructed of a second ring material 841 and include a second ring length 840 and second ring thickness 846. Third ring 836 may be constructed of a third ring material 843 and include a third ring length 842 and third ring thickness 848. Fourth ring 850 may be constructed of a fourth ring material 862 and include a fourth ring length 856 and fourth ring thickness 868. Fifth ring 852 may be constructed of a fifth ring material 864 and include a fifth ring length 858 and fifth ring thickness 870. Sixth ring 854 may be constructed of a sixth ring material 866 and include a sixth ring length 860 and sixth ring thickness 872.

In different embodiments, the shape, number, materials, and size of the rings included in kit 800 may vary. In the exemplary embodiment shown in FIG. 17, kit 800 includes rings that are generally circular in shape. However, in other embodiments, the rings may be of a different shape or of varying shapes. In some embodiments, kit 800 includes a sufficient number and type of rings so that a user can assemble a number of different studs with varying performance characteristics. For example, kit 800 may include rings that would allow a user to form a stud for use in dry weather, a stud for use in inclement weather, a stud for use indoors, and a stud for use outdoors. In other embodiments, kit 800 may include more or fewer types of rings.

In some embodiments, kit 800 may include only rings and/or washers suited for a particular purpose. For example, a user may already own or possess a complete stud, but may lack the rings best suited for use outdoors. Kit 800 may supply these rings. In other embodiments, kit 800 may supply rings suited for other purposes.

In the exemplary embodiment shown in FIG. 17, kit 800 includes six rings 832, 834, 836, 850, 852, 854. However, in other embodiments, more or less than six rings may be included in kit 800.

In the exemplary embodiment shown in FIG. 17, first, second, third, and fifth ring materials 839, 841, 843, 864 may be constructed of the same material. Fourth ring material 862 may be different from the other ring materials, and sixth ring material 866 may also be different from the other ring materials. Therefore, at least three different ring materials may be used in kit 800. However, in other embodiments, fewer, more, or different ring materials may be used.

In the exemplary embodiment shown in FIG. 17, first, second, third, fourth, fifth, and sixth ring lengths 838, 840, 842, 856, 858, 860 may vary. First ring length 838 may be smaller than second ring length 840 and approximately equal to fourth ring length 856. Second ring length 840 may be smaller than third ring length 842 and approximately equal to fifth ring length 858. Finally, third ring length 842 may be approximately equal to sixth ring length 860. However, in other embodiments, first, second, third, fourth, fifth, and sixth ring lengths 838, 840, 842, 856, 858, 860 may be approximately equal or vary in length in a different manner.

In the exemplary embodiment shown in FIG. 17, first, second, third, fourth, fifth, and sixth ring thicknesses 844, 846, 848, 868, 870, 872 may vary. First ring thickness 844 may be approximately equal to second ring, third ring, and sixth ring thicknesses 846, 848, 872. First ring thickness 844 may be thicker than fourth ring thickness 868 and thinner than fifth ring thickness 870. However, in other embodiments, first, second, third, fourth, fifth, and sixth ring thicknesses 844, 846, 848, 868, 870, 872 may be approximately equal or vary in thickness in a different manner.

Another embodiment may allow a manufacturer to custom form a stud in which the stud fastening member is permanently attached to one or more rings. This may be accomplished by bonding a single ring to the stud fastening member, bonding a combination of rings to the stud fastening member, using a mold to form a stud around the stud fastening member, or some combination of these methods.

Figure 18:
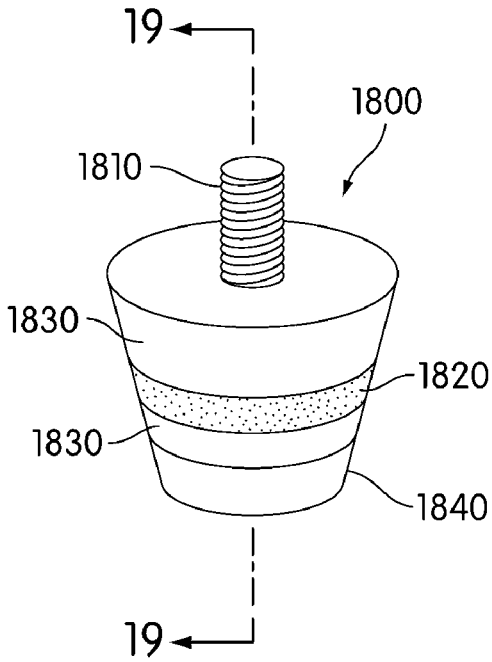
FIG. 18 is an isometric view of a finished stud molded around a ring.
Figure 19:
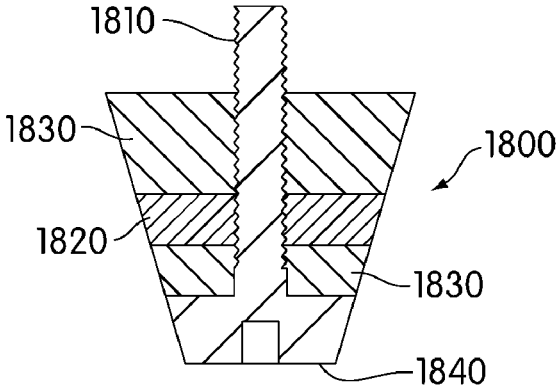
FIG. 19 is a section view of the finished stud of FIG. 18.

FIGS. 18 and 19 show an example of stud 1800 custom formed by permanently attaching one or more rings 1820. Stud fastening member 1810 may be molded to stud fastening member cap 1840 of stud fastening member 1810. Ring(s) 1820 may be molded into stud 1800 to allow stripes of different colors to show through, or to add a different modulus or other property to a portion of stud 1800. Molded portions 1830 may be of any material satisfactory for molding cleats.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A stud for an article of footwear, comprising:

a fastening member comprising a fastening member cap and a fastening member shaft;

a plurality of rings positioned along the fastening member shaft;

a washer disposed along the fastening member shaft sandwiching the plurality of rings between the washer and the fastening member cap;

wherein the washer comprises a washer first face having a washer recess to receive one of the plurality of rings; and wherein altering a characteristic of one of the plurality of rings along the fastening member shaft alters ground interaction characteristics of the stud.

2. The stud according to claim 1, wherein the fastening member cap further comprises a cap recess.

3. The stud according to claim 1, wherein the washer recess has a length that is at least as large as one of the plurality of rings.

4. The stud according to claim 1, wherein the washer further comprises a washer second face having a friction member configured to grip a sole of an article of footwear when the stud is coupled to the article of footwear.

5. The stud according to claim 1, wherein altering the position of one of the plurality of rings along the fastening member shaft alters a contour of the stud.

6. The stud according to claim 1, wherein a length of at least one of the plurality of rings differs from a remainder of the plurality of rings.

7. The stud according to claim 1, wherein a graphic is disposed on at least one of the plurality of rings.

8. The stud according to claim 1, wherein a material of at least one of the plurality of rings differs from the remainder of the plurality of rings.

9. The stud according to claim 1, wherein at least one of the plurality of rings is configured to be exchanged with a new ring made from a different material to alter the ground interaction characteristics of the stud.

10. The stud according to claim 1, wherein the plurality of rings includes a first number of rings; and wherein the first number of rings is configured to be altered to alter the ground interaction characteristics of the stud.

11. An article of footwear, comprising:

an upper;

a sole;

a fastening member removably attached to the sole, the fastening member comprising a fastening member cap and a fastening member shaft;

a plurality of rings placed along the fastening member shaft;

a washer disposed along the fastening member shaft sandwiching the plurality of rings between the washer and the fastening member cap;

wherein the washer comprises a washer first face having a washer recess to receive one of the plurality of rings; and wherein any one the plurality of rings is interchangeable with a new ring having a different ground interaction characteristic so that when the new ring is exchanged for any one of the plurality of rings, the ground interaction characteristics of the stud are altered.

12. The stud according to claim 11, wherein at least one ring of the plurality of rings has a different ground interaction characteristic than the rest of the plurality of rings.

13. The stud according to claim 12, wherein a length of at least one of the plurality of rings differs from a remainder of the plurality of rings.

14. A stud according to claim 12, wherein a thickness of at least one of the plurality of rings differs from the remainder of the plurality of rings.

15. A stud according to claim 12, wherein a material of at least one of the plurality of rings differs from the remainder of the plurality of rings.

16. A kit for customizing a stud for an article of footwear, the stud having a fastening member cap and a fastening member shaft, the kit comprising:

a plurality of rings, wherein each ring is configured to be removably associated with the fastening member shaft of the stud;

the plurality of rings having characteristics configured to customize the stud for a particular use when at least a portion of the plurality of rings are associated with the fastening member shaft of the stud;

a washer comprising a washer first face having a washer recess to receive one of the plurality of rings, wherein the washer is configured to be disposed along the fastening member shaft sandwiching the plurality of rings between the washer and the fastening member cap of the stud; and wherein a first configuration of the portion of the plurality of rings disposed along the fastening member shaft of the stud associated with a first order results in first ground interaction characteristics of the stud; and wherein a second configuration of the portion of the plurality of rings disposed along the fastening member shaft of the stud associated with a second order that is different from the first order results in second ground interaction characteristics of the stud, wherein the second ground interaction characteristics of the stud are different from the first ground interaction characteristics of the stud.

17. The kit for customizing a stud according to claim 16, wherein at least one of the plurality of rings is configured to have a ground interaction characteristic different from a remainder of the plurality of rings.

18. The kit for customizing a stud according to claim 17, wherein a length of at least one of the plurality of rings differs from a remainder of the plurality of rings.

19. The kit for customizing a stud according to claim 17, wherein a thickness of at least one of the plurality of rings differs from the remainder of the plurality of rings.

20. The kit for customizing a stud according to claim 17, wherein a material of at least one of the plurality of rings differs from the remainder of the plurality of rings.

* * * * *